US012781732B2

(12) United States Patent
Wagner et al.

(10) Patent No.: US 12,781,732 B2
(45) Date of Patent: Nov. 3, 2026

(54) HYDRAULIC FRACTURING PUMP SYSTEM USING A NETWORK OF CONTROLLERS

(71) Applicant: SPM Oil & Gas Inc., Fort Worth, TX (US)

(72) Inventors: Bryan Wagner, Fort Worth, TX (US); Reid Young, Fort Worth, TX (US); Ralph Harris, Fort Worth, TX (US); Chandu Kumar, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 14 days.

(21) Appl. No.: 18/963,225

(22) Filed: Nov. 27, 2024

(65) Prior Publication Data

US 2026/0146599 A1 May 28, 2026

(51) Int. Cl.
*F04B 51/00* (2006.01)
*E21B 43/26* (2006.01)

(52) U.S. Cl.
CPC ..... *F04B 51/00* (2013.01); *E21B 43/2607* (2020.05)

(58) Field of Classification Search
CPC ..... E21B 43/26; E21B 43/2607; E21B 47/00; E21B 47/12; F04B 51/00
See application file for complete search history.

(56) References Cited

U.S. PATENT DOCUMENTS

| | | | | |
|---|---|---|---|---|
| 6,625,627 | B2 * | 9/2003 | Haneda | G06F 3/0614 |
| 8,874,383 | B2 | 10/2014 | Gambier et al. | |
| 10,047,741 | B2 | 8/2018 | Zhang et al. | |
| 10,350,025 | B1 * | 7/2019 | Loyd | A61B 90/08 |
| 10,385,841 | B2 | 8/2019 | Zhang et al. | |
| 10,808,692 | B2 * | 10/2020 | Mackay | F04B 51/00 |
| 11,401,929 | B2 | 8/2022 | Stewart et al. | |
| 11,707,860 | B2 | 7/2023 | Vandergon et al. | |
| 12,018,441 | B2 * | 6/2024 | Mashek | E01C 23/088 |
| 12,366,242 | B2 * | 7/2025 | Harris | F04B 51/00 |

FOREIGN PATENT DOCUMENTS

| | | | | |
|---|---|---|---|---|
| CN | 117803564 A1 | | 4/2024 | |
| JP | 2021005323 A | * | 1/2021 | G16H 10/40 |

* cited by examiner

*Primary Examiner* — Franklin D Balseca

(57) ABSTRACT

A hydraulic fracturing pump system may include a hydraulic fracturing pump including a fluid end and a power end, a fluid end controller, mounted to the fluid end, storing a fluid end identifier that uniquely identifies the fluid end, a sensor configured to measure a parameter relating to the hydraulic fracturing pump, and a primary controller communicatively coupled to the sensor and to the fluid end controller. The primary controller may be configured to receive the fluid end identifier from the fluid end controller, obtain measurements from the sensor, generate a report that indicates data based on the measurements, and transmit the report to the fluid end controller.

20 Claims, 4 Drawing Sheets

HYDRAULIC FRACTURING PUMP SYSTEM USING A NETWORK OF CONTROLLERS

TECHNICAL FIELD

The present disclosure relates generally to hydraulic fracturing systems and, for example, to a hydraulic fracturing pump system using a network of controllers.

BACKGROUND

Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

During hydraulic fracturing operations, a controller mounted on a hydraulic fracturing pump may collect data from various sensors connected to the pump. At an end of a useful life of the pump, which occurs much sooner than a lifespan of the controller, the pump can be replaced with a new pump having its own controller. This approach inefficiently utilizes the controllers and produces significant electronic waste. Moreover, the controller adds additional bulkiness to the pump, thereby making installation, maintenance, and servicing of the pump more cumbersome.

The Pump System of the Present Disclosure Solves One or More of the Problems Set Forth Above and/or Other Problems in the Art.

SUMMARY

A trailer system for a hydraulic fracturing system may include a trailer having one or more sets of wheels, a hydraulic fracturing pump, including a fluid end and a power end, mounted on the trailer, a fluid end controller, mounted to the fluid end, storing a fluid end identifier that uniquely identifies the fluid end, a power end controller, mounted to the power end, storing a power end identifier that uniquely identifies the power end, a sensor configured to measure a parameter relating to the hydraulic fracturing pump, and a primary controller mounted on the trailer remotely from the hydraulic fracturing pump. The primary controller may be configured to transmit requests for identifying information to the fluid end controller and the power end controller, receive, responsive to the requests, the fluid end identifier from the fluid end controller and the power end identifier from the power end controller, generate a report that indicates the fluid end identifier, the power end identifier, and data based on measurements of the sensor, and transmit the report to the fluid end controller and to the power end controller.

A hydraulic fracturing pump system may include a hydraulic fracturing pump including a fluid end and a power end, a fluid end controller, mounted to the fluid end, storing a fluid end identifier that uniquely identifies the fluid end, a sensor configured to measure a parameter relating to the hydraulic fracturing pump, and a primary controller communicatively coupled to the sensor and to the fluid end controller. The primary controller may be configured to receive the fluid end identifier from the fluid end controller, obtain measurements from the sensor, generate a report that indicates data based on the measurements, and transmit the report to the fluid end controller.

A method may include detecting, by a primary controller of a hydraulic fracturing pump system, a communication connection to a controller mounted to a fluid end or a power end of a hydraulic fracturing pump of the hydraulic fracturing pump system. The method may include transmitting, by the primary controller and based on detecting the communication connection, a request for identifying information to the controller. The method may include receiving, by the primary controller in response to the request, an identifier from the controller, where the identifier uniquely identifies the fluid end or the power end. The method may include obtaining, by the primary controller, measurements from a plurality of sensors connected to the hydraulic fracturing pump. The method may include generating, by the primary controller, a report that indicates data based on the measurements. The method may include transmitting, by the primary controller, the report to the controller.

DETAILED DESCRIPTION

This disclosure relates to a pump system, which is applicable to any fluid pump. For example, the pump system may be used with a type of reciprocating pump, such as a hydraulic fracturing pump.

Figure 1:
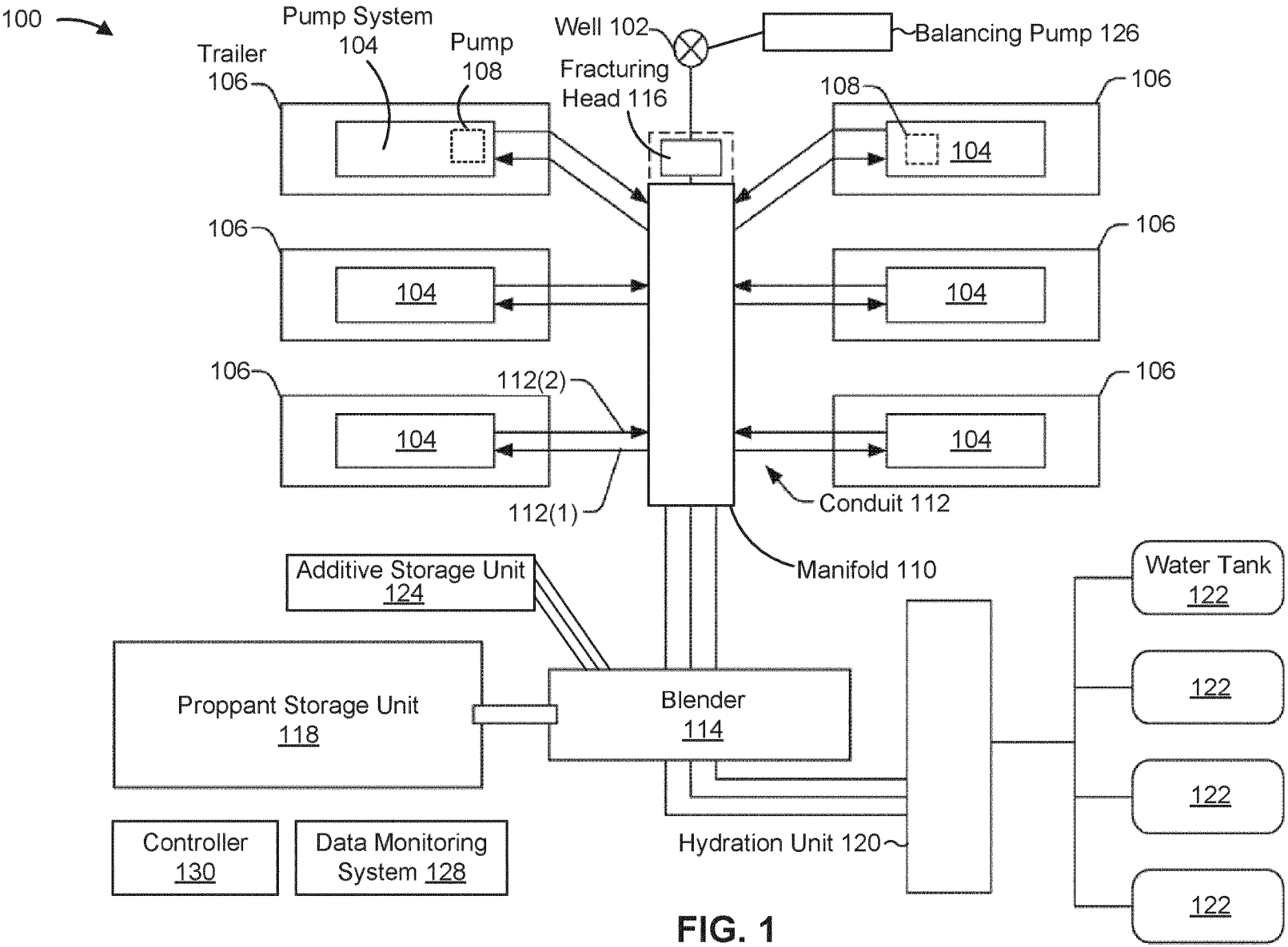
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 (e.g., hydraulic fracturing pump systems) that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps, such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100.

As indicated above, FIG. 1 is provided as an example. Other examples may differ from what is described with regard to FIG. 1.

Figure 2:
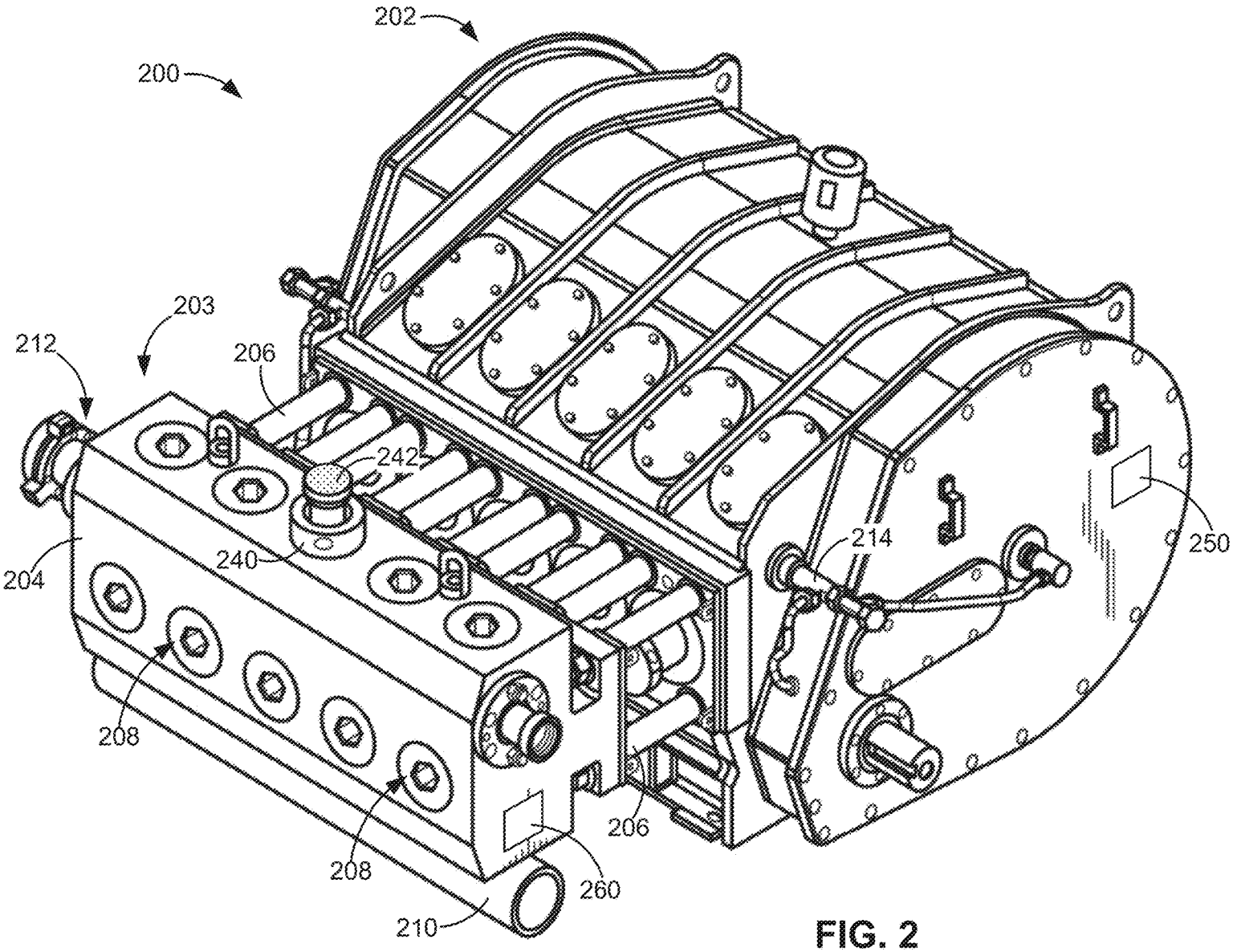
FIG. 2 is a diagram illustrating a perspective view of an example fluid pump.

FIG. 2 is a diagram illustrating a perspective view of an example fluid pump 200. The fluid pump 200 may correspond to a fluid pump 108 described in connection with FIG. 1. The fluid pump 200 may be a reciprocating pump, as shown.

The fluid pump 200 includes a power end 202 and a fluid end 203 having a fluid end block 204. The fluid end 203 may be connected to the power end 202 by stay rods 206. The fluid end block 204 defines one or more fluid chambers 208 (shown as five fluid chambers 208 in FIG. 2). For example, the fluid pump 200 may include one, two, three, four, five, or more fluid chambers 208 and associated components.

As an example, each fluid chamber 208 may include a suction valve to control fluid suction into the fluid chamber 208, and a discharge valve to control fluid discharge from the fluid chamber 208. Each fluid chamber 208 may be associated with a plunger. During a suction stroke of the plunger, fluid is allowed to flow from a suction manifold 210 through the suction valve and into the fluid chamber 208. The fluid is then pumped in response to a discharge stroke (e.g., a forward stroke) of the plunger and flows through the discharge valve into a discharge manifold 212. The discharge manifold 212 may be fluidly coupled to a wellbore to supply high pressure fluid to the wellbore for fracturing rock formations and other uses. In operation, the plunger is driven by the power end 202 of the fluid pump 200. For example, the power end 202 may include a crankshaft that is rotated by a gearbox output. A gearbox input is coupled to a transmission and a power source, such as a diesel engine, to rotate the gearbox input during operation.

A gauge port 240 may be attached to the fluid pump 200. For example, the gauge port 240 may be attached to the power end 202 or to the fluid end 203 (e.g., to the fluid end block 204). As shown, the gauge port 240 may be attached to the fluid end block 204 in fluid communication with the discharge manifold 212, which facilitates measurement of a discharge pressure of the fluid pump 200. Alternatively, the gauge port 240 may be attached to the suction manifold 210 (e.g., to facilitate measurement of a suction pressure of the fluid pump 200), to another fluid passageway of the fluid end 203, to a fluid passageway of the power end 202 (e.g., a lubrication passageway, such as lubrication passageway 214, to facilitate measurement of an oil pressure or an oil temperature), or to another part of the power end 202 or fluid end 203 from which measurements relating to the fluid pump 200 can be collected.

The gauge port 240 is configured to provide a connection point for a sensor 242. Thus, the sensor 242 may be coupled to the gauge port 240, and the sensor 242 may be configured to collect, via the gauge port 240, measurements relating to a parameter (e.g., a fluid parameter) of the fluid pump 200. The parameter may be a discharge pressure of the fluid pump 200, a suction pressure of the fluid pump 200, an oil pressure of the fluid pump 200, or an oil temperature of the fluid pump 200 (e.g., in a lubrication passageway of the power end 202), among other examples. Thus, the sensor 242 may be a pressure sensor, a temperature sensor, or another type of sensor. In some examples, the fluid pump 108 may include a plurality of gauge ports 240 and a plurality of associated sensors 242. Additionally, or alternatively, one or more sensors 242 may be connected to the fluid pump 108 without the use of a gauge port 240.

In some examples, a power end controller 250 may be mounted to the power end 202 (e.g., by fasteners, such as bolts). For example, the power end controller 250 may be mounted to a housing of the power end 202. In some examples, a fluid end controller 260 may be mounted to the fluid end 203 (e.g., by fasteners, such as bolts). For example, the fluid end controller 260 may be mounted to the fluid end block 204.

As indicated above, FIG. 2 is provided as an example. Other examples may differ from what is described with regard to FIG. 2.

Figure 3:
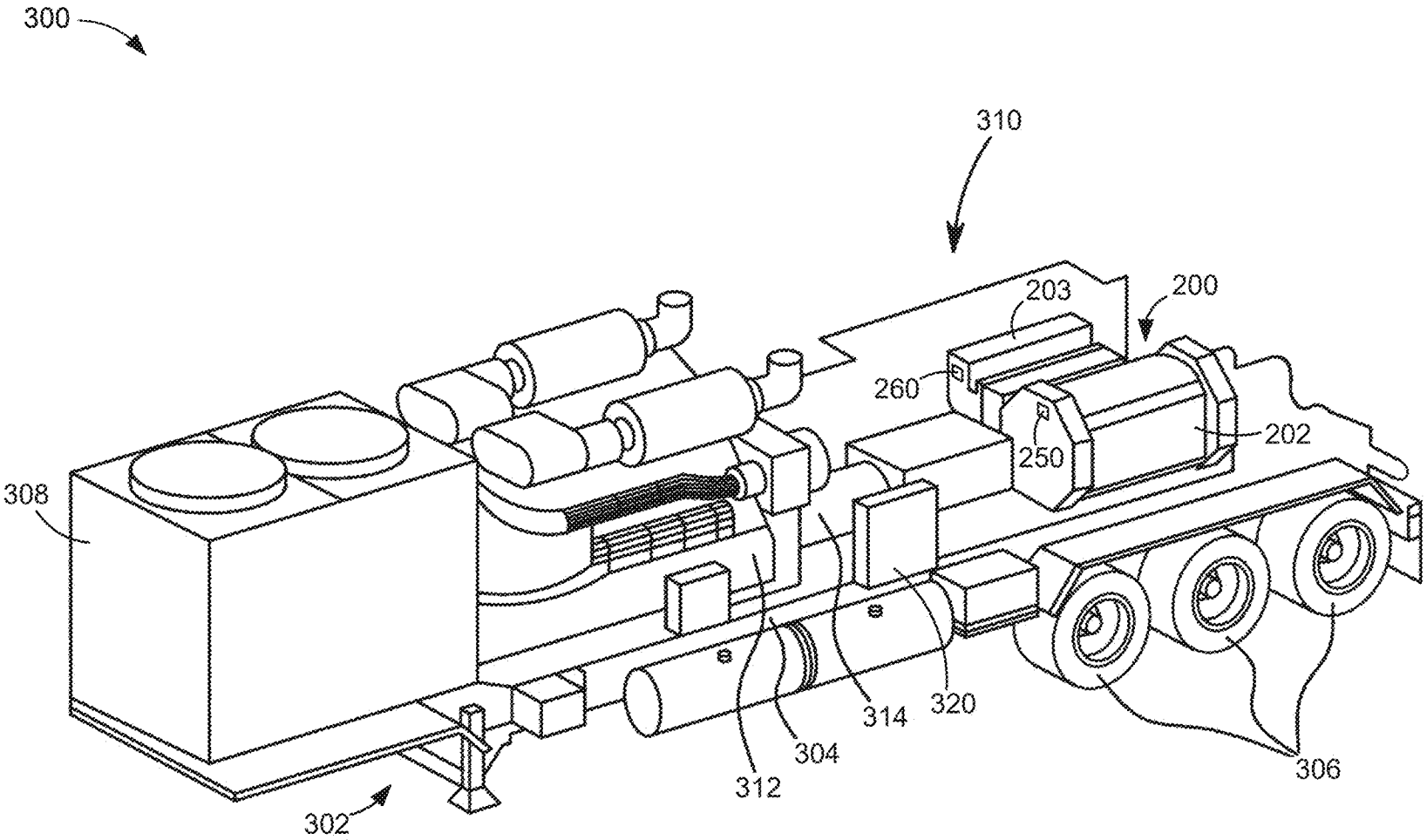
FIG. 3 is a perspective view of an example trailer system.

FIG. 3 is a perspective view of an example trailer system 300. The trailer system 300 may include a trailer 302 (e.g., corresponding to trailer 106). The trailer 302 includes a frame 304 and one or more sets of wheels 306 coupled to the frame 304. The wheels 306 provide mobility for the trailer 302 to enable the trailer 302 to be towed (e.g., by a truck or tractor unit), such as to different hydraulic fracturing sites or to different locations within a hydraulic fracturing site.

A cooling system 308 and/or a pump system 310 may be mounted on the trailer 302. The cooling system 308 may operationally cool, or otherwise remove thermal energy from, the pump system 310 and/or other components of the trailer 302. For example, the cooling system 308 may pump cooling fluid (e.g., oil, water, or the like) to components of the pump system 310 and/or other components of the trailer 302.

The pump system 310 (e.g., corresponding to pump system 104) may include the fluid pump 200 (having a power end 202 and a fluid end 203), an engine 312, and a transmission 314, among other examples, mounted on the trailer 302. The engine 312 may be operably coupled to the fluid pump 200 via the transmission 314. Thus, the engine 312 may drive the fluid pump 200, thereby providing the power for pressurization of fracturing fluid by the fluid pump 200. The engine 312 may be an internal combustion engine, such as a gaseous fuel engine (e.g., a spark-ignited gaseous fuel engine), a diesel engine (e.g., a diesel-compression ignition engine), a gasoline engine, or the like. The transmission 314 may be an automatic transmission, a continuously variable transmission (CVT), or a clutch transmission, among other examples.

The pump system 310 may include the power end controller 250, the fluid end controller 260, and/or a primary controller 320. The power end controller 250, the fluid end controller 260, and/or a primary controller 320 may be electronic control modules (ECMs). In some examples, the primary controller 320 may be a pump electronic monitoring system.

The power end controller 250, the fluid end controller 260, and/or the primary controller 320 may include one or more memories and one or more processors communicatively coupled to the one or more memories. A processor may include a central processing unit, a graphics processing unit, a microprocessor, a controller, a microcontroller, a digital signal processor, a field-programmable gate array, an application-specific integrated circuit, and/or another type of processing component. The processor may be implemented in hardware, firmware, or a combination of hardware and software. The processor may be capable of being programmed to perform one or more operations or processes described elsewhere herein. A memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may be a non-transitory computer-readable medium. The memory may store information, one or more instructions, and/or software (e.g., one or more software applications) related to the operation of the power end controller 250, the fluid end controller 260, and/or a primary controller 320.

Rather than using a single pump-level controller applicable to the power end 202 and the fluid end 203, the pump system 310 may employ a disaggregated controller architecture using the power end controller 250, the fluid end controller 260, and/or the primary controller 320. The power end controller 250, the fluid end controller 260, and the primary controller 320 can be located at (e.g., mounted to) various locations of the trailer system 300. In a fully disaggregated configuration, the power end controller 250 may be mounted to the power end 202, the fluid end controller 260 may be mounted to the fluid end 203, and the primary controller 320 may be mounted on the trailer 302 (e.g., located remotely from the fluid pump 200). In a partially disaggregated configuration, the fluid end controller 260 may be mounted to the fluid end 203 and the primary controller 320 may be mounted to the power end 202 (e.g., omitting a separate power end controller 250). Alternatively, in the partially disaggregated configuration, the power end controller 250 may be mounted to the power end 202 and the primary controller 320 may be mounted to the fluid end 203 (e.g., omitting a separate fluid end controller 260).

The fluid end controller 260 may be configured to store (e.g., in a memory) a fluid end identifier that uniquely identifies the fluid end 203. The fluid end identifier may be a serial number or another number or code that is assigned to the fluid end 203 and therefore can be used to specifically identify the fluid end 203. The power end controller 250 may be configured to store a power end identifier that uniquely identifies the power end 202. The power end identifier may be a serial number or another number or code (e.g., different from that of the fluid end 203) that is assigned to the power end 202 and therefore can be used to specifically identify the power end 202. In some examples, the fluid end controller 260 and the power end controller 250 may be electronic tags configured to store the fluid end identifier and the power end identifier, respectively.

The fluid pump 200 (and/or the power end 202 or the fluid end 203 individually) may be replaced on the trailer 302 at an end of its useful life. In the fully disaggregated configuration, the fluid end 203 and/or the power end 202 may be replaced on the trailer 302, while the primary controller 320 remains with the trailer 302 (e.g., mounted on the trailer 302). In other words, in the fully disaggregated configuration, replacement of the power end 202 and/or the fluid end 203 does not also require replacement of the primary controller 320 due to the primary controller 320 being located remotely from the fluid pump 200. In the partially disaggregated configuration, the fluid end 203 may be replaced on the trailer 302, while the primary controller 320 remains mounted to the power end 202. In other words, in the partially disaggregated configuration, replacement of the fluid end 203 does not also require replacement of the primary controller 320 due to the primary controller 320 being located on the power end 202, or vice versa.

Accordingly, the primary controller 320 may be utilized at a trailer level rather than at a pump level (e.g., the primary controller 320 may interact with numerous pumps that are replaced on the trailer 302, rather than interacting with only a single pump), while the fluid end controller 260 and the power end controller 250 may be particular to the fluid end 203 and the power end 202, respectively. Thus, the fluid end controller 260 and the power end controller 250 may be relatively small and operate even with relatively limited computing power and memory compared to the primary controller 320. For example, respective memory capacities of the fluid end controller 260 and the power end controller 250 may be less than a memory capacity of the primary controller 320. Thus, computing power and memory is more efficiently allocated among the controllers, with less computing power and memory being allocated to controllers 250, 260 that are more frequently replaced and with more computing power and memory being allocated to the primary controller 320 that is less frequently replaced (or not replaced).

The sensor 242 may be configured to measure a parameter relating to the fluid pump 200. In some examples, the sensor 242 may be or include a speed sensor, a proximity sensor (e.g., with a speed timing wheel), a vibration sensor (e.g., on the power end 202, or the fluid end 203), a pressure sensor (e.g., for discharge pressure, suction pressure, lube inlet/outlet pressure, etc.), or a temperature sensor (e.g., for lube inlet/outlet temperature, lube drain temperature, etc.), among other examples. The sensor 242 may be communicatively coupled to the primary controller 320. For example, the sensor 242 may be hardwired or wirelessly connected with the primary controller 320. The sensor 242 may be configured to provide a measured parameter to the primary controller 320 and/or receive a control signal from the primary controller 320. Similarly, the primary controller 320 may be configured to obtain measurements from the sensor 242 and/or provide a control signal to the sensor 242. In some examples, the trailer system 300 may include a plurality of sensors, including the sensor 242, connected to the fluid pump 200.

The primary controller 320 is communicatively coupled to the fluid end controller 260 and the power end controller 250 (e.g., to enable the exchange of information between the primary controller 320 and the fluid end controller 260 or the power end controller 250). In some examples, the fluid end controller 260 and the power end controller 250 may be communicatively coupled to each other (e.g., to enable the exchange of information between the fluid end controller 260 and the power end controller 250). These communication connections between the primary controller 320, the fluid end controller 260, and the power end controller 250 may be wired connections and/or wireless connections. For example, at least two of the primary controller 320, the fluid end controller 260, and the power end controller 250 may be connected on a network.

In some examples, the trailer system 300 may include, or may be connected to, an electrical system (e.g., a generator, grid power, a solar power system, a wind power system, or the like) to supply power to the primary controller 320, the fluid end controller 260, and/or the power end controller 250. For example, the primary controller 320 may include, or may be connected to, a power supply system to supply power to the fluid end controller 260 and/or the power end controller 250 (e.g., via a hardwired connection). In some examples, the fluid end controller 260 and/or the power end controller 250 may include a respective battery.

After the fluid pump 200, the power end 202, or the fluid end 203 is mounted on the trailer 302 (e.g., as a replacement), the primary controller 320 may detect a communication connection (e.g., an establishment of the communication connection) with the fluid end controller 260 and/or the power end controller 250. For example, the communication connection may include a wireless communication connection or a hardwiring between the primary controller 320 and the fluid end controller 260 and/or the power end controller 250. The primary controller 320 may transmit requests for identifying information to the fluid end controller 260 and/or the power end controller 250. The primary controller 320 may transmit the requests for identifying information responsive to detecting the respective communication connections. For example, the primary controller 320 may transmit the request to the fluid end controller 260 responsive to detecting the connection with the fluid end controller 260, and/or the primary controller 320 may transmit the request to the power end controller 250 responsive to detecting the connection with the power end controller 250.

Responsive to a request for identifying information, the fluid end controller 260 may transmit, and the primary controller 320 may receive the fluid end identifier. Similarly, responsive to a request for identifying information, the power end controller 250 may transmit, and the primary controller 320 may receive, the power end identifier. This exchange of information enables the primary controller 320 to particularly identify a new power end and/or a new fluid end that has been replaced on the trailer 302. Accordingly, as new power end and/or fluid end measurements are collected by the sensor(s) 242, the primary controller 320 may associate these measurements with the new fluid end identifier and/or the new power end identifier. Because the primary controller 320 is not replaced at the same frequency as the power end 202 and/or the fluid end 203, the primary controller 320 may also retain data relating to previous and future fluid ends and/or power ends used in the trailer system 300, thereby producing a robust data set that may span a life of the trailer system 300.

In some examples, the primary controller 320 may store raw data for the measurements collected by the sensor(s) 242. Additionally, or alternatively, the primary controller 320 may process the raw data to generate new data. The primary controller 320 may generate a report (e.g., a status report) that indicates data based on the measurements (e.g., data that includes the raw data and/or the new data). For example, the primary controller 320 may generate a report that indicates the fluid end identifier, the power end identifier, and/or the data (e.g., thereby indicating that the data relates to this particular power end 202 and/or fluid end 203). In some examples, the primary controller 320 may generate separate reports for the power end 202 and the fluid end 203, including a first report that indicates first data relating to the power end 202 and a second report that indicates second data relating to the fluid end 203.

In some examples, the primary controller 320 may update the report (e.g., generate a new report) based on a set interval (e.g., every second, every minute, etc.). The report may indicate the raw data and/or the new data in a tabular format and/or a graphical format. In some examples, the report may indicate relationships between different measurements collected by different sensors 242, such as a relationship between discharge pressure and revolutions per minute (RPM), a relationship between lube pressure and RPM, or the like. Because each report may contain a significant amount of data, the primary controller 320 may generate the report as an electronic file that contains the report in an image format (e.g., a portable document format (PDF) file, a portable network graphics (PNG) file, or the like). By using an image, the electronic file may have a smaller size than the data as individual data points, thereby providing data compression. Thus, the electronic file may be suitable for storing on the power end controller 250 and/or fluid end controller 260, which have lesser memory capacities than the primary controller 320.

The primary controller 320 may transmit the report (e.g., the electronic file) to the fluid end controller 260 and/or the power end controller 250. For example, the primary controller 320 may transmit reports to the fluid end controller 260 and/or the power end controller 250 at the set interval at which the primary controller 320 updates the reports (e.g., every second, every minute, etc.). As used herein, "report" may refer to any information in any format that is intended for communication or storage by the primary controller 320, the power end controller 250, and/or the fluid end controller 260. In some examples, a report may contain only a single type or set of information.

As described herein, the fluid end controller 260 and/or the power end controller 250 may have a limited storage capacity and may be unable to store all of the reports received from the primary controller 320. Thus, when receiving a new report (e.g., a new electronic file) the fluid end controller 260 and/or the power end controller 250 may delete an oldest report (e.g., an oldest electronic file) stored on the fluid end controller 260 and/or the power end controller 250, thereby freeing up memory capacity in order to store the new report. That is, the fluid end controller 260 and/or the power end controller 250 may perform a first-in, first-out (FIFO) function to update the report (e.g., the electronic file) stored therein. When the fluid end 203 and/or the power end 202 is removed from the trailer 302, these reports stored on the fluid end controller 260 and/or the power end controller 250 travel with the fluid end 203 and/or the power end 202 (e.g., to a repair facility, to a scrap yard, or the like), thereby providing valuable data useful for repair technicians or forensic analysis.

After being removed from the trailer 302, the power end 202 and/or the fluid end 203 may be replaced with a different power end having its own power end controller and/or a different fluid end having its own fluid end controller. When this occurs, the primary controller 320 may detect a new communication connection with this different power end controller and/or different fluid end controller, may transmit a new request for identifying information, and may receive in response a different fluid end identifier and/or a different power end identifier associated with the different power end and/or the different fluid end, in a similar manner as described above.

Because the primary controller 320 has a greater storage capacity than the fluid end controller 260 and the power end controller 250, the primary controller 320 may retain reports for multiple fluid pumps, power ends, and/or fluid ends that have been employed in the trailer system 300. For example, the primary controller 320 may store one or more reports relating to the power end 202 and/or the fluid end 203, and store one or more different reports relating to the different power end and/or the different fluid end 203 that is a replacement for the power end 202 and/or the fluid end 203. In this way, the primary controller 320 may serve the trailer system 300, rather than serving a single fluid pump, thereby more efficiently utilizing computing and memory resources of the primary controller 320.

As indicated above, FIG. 3 is provided as an example. Other examples may differ from what is described with regard to FIG. 3.

Figure 4:
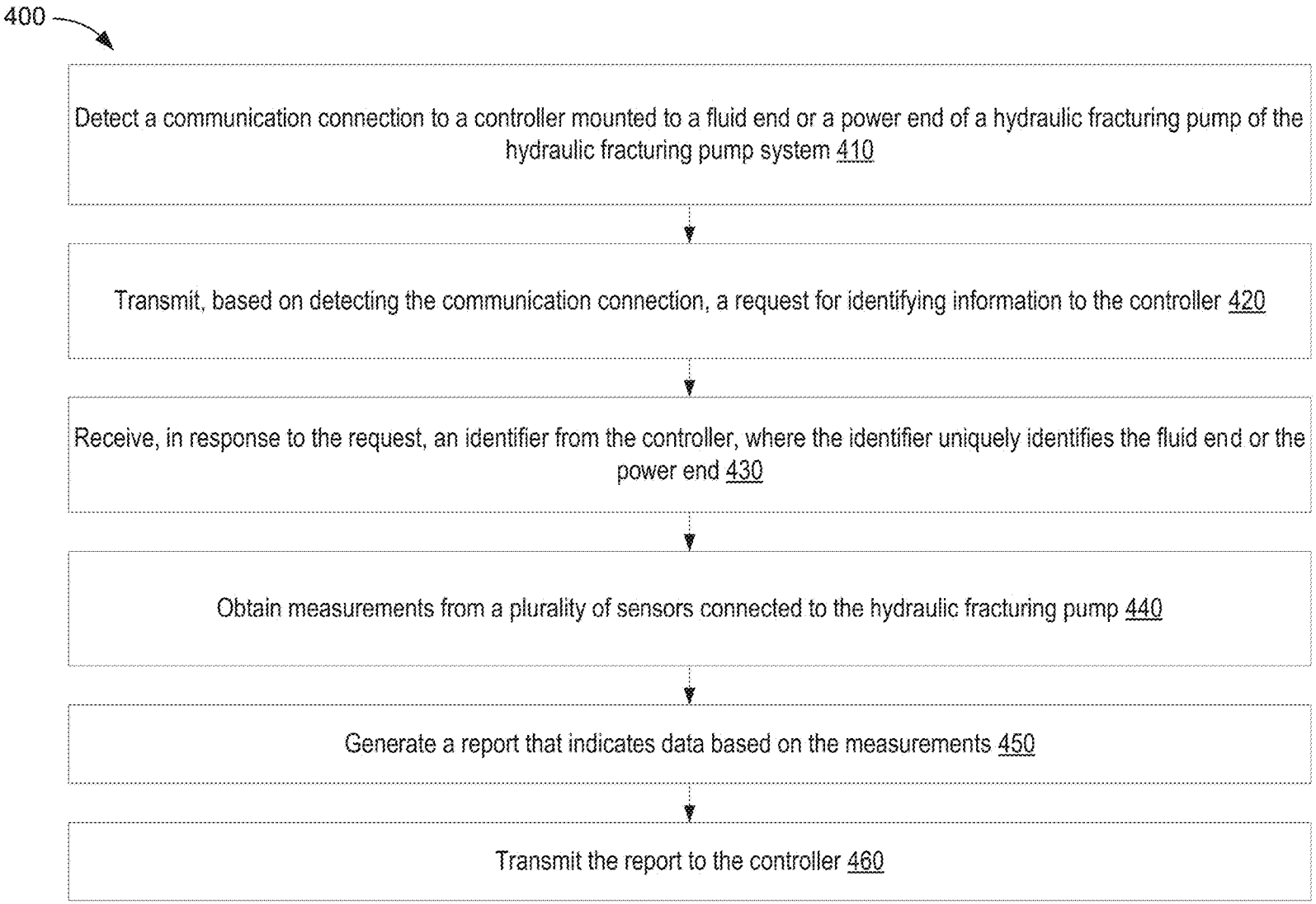
FIG. 4 is a flowchart of an example method associated with a hydraulic fracturing pump system using a network of controllers.

FIG. 4 is a flowchart of an example method 400 associated with a hydraulic fracturing pump system using a network of controllers. One or more steps of method 400 may be performed by the power end controller 250, the fluid end controller 260, and/or the primary controller 320. Additionally, or alternatively, one or more steps of method 400 may be performed by another device or a group of devices separate from or including the power end controller 250, the fluid end controller 260, and/or the primary controller 320, such as another device or component that is internal or external to the trailer system 300.

At step 410, the method 400 may include detecting (e.g., using the primary controller 320) a communication connection to a controller (e.g., the fluid end controller 260, the power end controller 250, etc.) mounted to a fluid end (e.g., the fluid end 203) or a power end (e.g., the power end 202) of a hydraulic fracturing pump (e.g., the pump 200) of the hydraulic fracturing pump system.

At step 420, the method 400 may include transmitting (e.g., using the primary controller 320) a request for identifying information to the controller. For example, the method 400 may include transmitting (e.g., using the primary controller 320) the request, based on detecting the communication connection. In some examples, the method 400 may include transmitting (e.g., using the primary controller 320) a request for identifying information, such as a fluid end identifier that uniquely identifies the fluid end or a power end identifier that uniquely identifies the power end, to the controller (e.g., the fluid end controller 260, the power end controller 250, etc.).

At step 430, the method 400 may include receiving (e.g., using the primary controller 320) an identifier from the controller. For example, the method 400 may include receiving (e.g., using the primary controller 320), in response to the request, an identifier (e.g., the identifying information, the fluid end identifier, the power end identifier, information that uniquely identifies the fluid end or the power end, etc.) from the controller (e.g., the fluid end controller 260, the power end controller 250, etc.).

At step 440, the method 400 may include obtaining (e.g., using the primary controller 320) measurements from a sensor (e.g., the sensor 242). In some examples, the method 400 may include obtaining (e.g., using the primary controller 320) measurements from a plurality of sensors connected to the hydraulic fracturing pump.

At step 450, the method 400 may include generating (e.g., using the primary controller 320) a report that indicates data based on the measurements. In some examples, the method 400 may include generating (e.g., using the primary controller 320) an electronic file that contains the report in an image format. In some examples, the method 400 may include updating (e.g., using the primary controller 320) the report at a set interval (e.g., every second, every minute, etc.). In some examples, the method 400 may include generating (e.g., using the primary controller 320) the report including one or more values from the measurements.

At step 460, the method 400 may include transmitting (e.g., using the primary controller 320) the report to the controller. In some examples, the method 400 may include transmitting (e.g., using the primary controller 320) the electronic file (e.g., generated at step 450) to the controller. In some examples, the method 400 may include storing the report and a different report relating to a different fluid end or a different power end.

In some examples, the method 400 may include detecting (e.g., using the primary controller 320) a new communication connection to a different controller mounted to a different fluid end or a different power end that is a replacement for the fluid end or the power end in the hydraulic fracturing pump system. In some examples, the method 400 may include transmitting (e.g., using the primary controller 320), based on detecting the new communication connection, a new request for identifying information to a different controller. For example, the method 400 may include transmitting (e.g., using the primary controller 320) the new request to a different controller mounted to the different fluid end or the different power end. In some examples, the method 400 may include receiving (e.g., using the primary controller 320) a different identifier from the different controller. For example, the method 400 may include receiving (e.g., using the primary controller 320), in response to the new request, a different identifier from the different controller.

Although FIG. 4 shows example steps of method 400, in some implementations, method 400 may include additional steps, fewer steps, different steps, or differently arranged steps than those depicted in FIG. 4. Additionally, or alternatively, two or more of the steps of method 400 may be performed in parallel.

INDUSTRIAL APPLICABILITY

The pump system 310 described herein may be used with any fluid pump. For example, the pump system 310 may be used with a fluid pump that includes a fluid end and a power end that can be connected and disconnected. In one example, the pump system 310 may be used with a hydraulic fracturing pump in connection with the recovery of water, oil, natural gas, and/or other fluids from a rock formation. The pump system 310 facilitates monitoring of parameters relating to the hydraulic fracturing pump during hydraulic fracturing operations, which provides useful data for diagnostics and maintenance that facilitate extending the useful life of the pump. In general, a controller mounted on a hydraulic fracturing pump may collect data from various sensors connected to the pump. At an end of a useful life of the pump, which occurs much sooner than a lifespan of the controller, the pump can be replaced with a new pump having its own controller. This approach inefficiently utilizes the controllers and produces significant electronic waste.

The pump system 310 described herein facilitates more efficient use of controllers that provide pump monitoring. In particular, as described herein, the power end controller 250 may be mounted on the power end 202 of the pump 200 and/or the fluid end controller 260 may be mounted on the fluid end 203 of the pump 200. These controllers 250, 260 are relatively small and have relatively limited computing power and memory compared to the primary controller 320, thereby making the controllers 250, 260 a more efficient and less bulky choice for mounting to the power end 202 and the fluid end 203. In some examples, as described herein, the primary controller 320 is mounted on the trailer 302 remotely from the pump 200. This allows the primary controller 320 to remain with the trailer 302 even when the power end 202, the fluid end 203, or the entire pump 200 is replaced, thereby more efficiently utilizing the primary controller 320 at a trailer level rather than at a pump level.

In this configuration, certain challenges may arise regarding the collection, processing, communication, and storage of data between controllers. Techniques described herein enable the primary controller 320 to maintain a robust and pump-specific data set encompassing multiple pumps that are swapped onto the trailer 302 over a lifetime of the trailer 302 and/or of the primary controller 320. Moreover, the power end controller 250 and/or the fluid end controller 260 may also maintain data specific to the operation of a particular power end 202 or a particular fluid end 203, and such data travels with the power end 202 or fluid end 203 even after the same have been removed from the pump system 310, thereby providing long-term data persistence useful for diagnostic applications or repairs.

The foregoing describes only some embodiments, and alterations, modifications, additions and/or changes can be made thereto without departing from the scope and spirit of the disclosed embodiments, the embodiments being illustrative and not restrictive. Furthermore, implementations are not limited to the disclosed embodiments, and may cover various modifications and equivalent arrangements included within the spirit and scope of the disclosed embodiments. Also, the various embodiments described above may be implemented in conjunction with other embodiments, for example, aspects of one embodiment may be combined with aspects of another embodiment to realize yet other embodiments. Further, each independent feature or component of any given assembly or process may constitute an additional embodiment. As used herein, the singular forms of "a," "an," and "the" include plural referents unless the context clearly dictates otherwise. In addition, as used herein, the term "or" means "and/or" unless the context clearly dictates otherwise.

When "a controller" or "one or more controllers" is described or claimed (within a single claim or across multiple claims) as performing multiple operations or being configured to perform multiple operations, unless described or claimed otherwise (e.g., via the use of "first controller" and "second controller" or other language that differentiates controllers) this language is intended to cover a single controller performing or being configured to perform all of the operations, a group of controllers collectively performing or being configured to perform all of the operations, a first controller performing or being configured to perform a first operation and a second controller performing or being configured to perform a second operation, or any combination of controllers performing or being configured to perform the operations.

What is claimed is:

1. A trailer system for a hydraulic fracturing system, comprising:

a trailer having one or more sets of wheels;

a hydraulic fracturing pump, comprising a fluid end and a power end, mounted on the trailer;

a fluid end controller, mounted to the fluid end, storing a fluid end identifier that uniquely identifies the fluid end;

a power end controller, mounted to the power end, storing a power end identifier that uniquely identifies the power end;

a plurality of sensors configured to measure parameters relating to the hydraulic fracturing pump; and a primary controller, communicatively coupled to the plurality of sensors, mounted on the trailer remotely from the hydraulic fracturing pump, and having a memory capacity and a computing power greater than respective memory capacities and respective computing powers of the fluid end controller and the power end controller, configured to:

transmit requests for identifying information to the fluid end controller and the power end controller;

receive, responsive to the requests, the fluid end identifier from the fluid end controller and the power end identifier from the power end controller;

obtain measurements from the plurality of sensors and associate fluid end measurements of the measurements with the fluid end identifier and power end measurements of the measurements with the power end identifier;

generate a report that indicates the fluid end identifier in relation to first data based on the fluid end measurements, and the power end identifier in relation to second data based on the power end measurements; and transmit the report to the fluid end controller and to the power end controller.

2. The trailer system of claim 1, wherein the primary controller, to generate the report, is configured to generate an electronic file that contains the report in an image format, and wherein the primary controller, to transmit the report to the fluid end controller and to the power end controller, is configured to transmit the electronic file to the fluid end controller and to the power end controller.

3. The trailer system of claim 2, wherein the fluid end controller or the power end controller is configured to:

delete an oldest electronic file stored on the fluid end controller or the power end controller; and store the electronic file.

4. The trailer system of claim 1, wherein the primary controller is further configured to:

store the report and a different report relating to at least one of a different fluid end or a different power end that is a replacement for at least one of the fluid end or the power end on the trailer.

5. The trailer system of claim 1, wherein the plurality of sensors include at least one of a speed sensor, a vibration sensor, a pressure sensor, or a temperature sensor.

6. The trailer system of claim 1, wherein the primary controller is further configured to:

detect respective communication connections with the fluid end controller and the power end controller, wherein the primary controller, to transmit the requests, is configured to transmit the requests responsive to detecting the respective communication connections.

7. The trailer system of claim 1, wherein the primary controller is further configured to:

detect a new communication connection to a different controller mounted to a different fluid end or a different power end that is a replacement for the fluid end or the power end in the hydraulic fracturing pump;

transmit, based on detecting the new communication connection, a new request for identifying information to the different controller; and receive, in response to the new request, a different identifier from the different controller, wherein the different identifier uniquely identifies the different fluid end or the different power end.

8. A hydraulic fracturing pump system, comprising:

a hydraulic fracturing pump comprising a fluid end and a power end;

a fluid end controller, mounted to the fluid end, storing a fluid end identifier that uniquely identifies the fluid end;

a power end controller, mounted to the power end, storing a power end identifier that uniquely identifies the power end;

a plurality of sensors configured to measure parameters relating to the hydraulic fracturing pump; and a primary controller, communicatively coupled to the plurality of sensors and having a memory capacity and a computing power greater than respective memory capacities and respective computing powers of the fluid end controller and the power end controller, configured to:

receive the fluid end identifier from the fluid end controller and the power end identifier from the power end controller;

obtain measurements from the plurality of sensors and associate fluid end measurements of the measurements with the fluid end identifier and power end measurements of the measurements with the power end identifier;

generate a report that indicates the fluid end identifier in relation to first data based on the fluid end measurements, and the power end identifier in relation to second data based on the power end measurements; and transmit the report to the fluid end controller and to the power end controller.

9. The hydraulic fracturing pump system of claim 8, wherein the primary controller is remotely located from the hydraulic fracturing pump.

10. The hydraulic fracturing pump system of claim 8, wherein the primary controller, to generate the report, is configured to generate an electronic file that contains the report in an image format, and wherein the primary controller, to transmit the report to the fluid end controller and to the power end controller, is configured to transmit the electronic file to the fluid end controller and to the power end controller.

11. The hydraulic fracturing pump system of claim 10, wherein the fluid end controller or the power end controller is configured to:

delete an oldest electronic file stored on the fluid end controller or the power end controller; and store the electronic file.

12. The hydraulic fracturing pump system of claim 8, wherein the primary controller is further configured to:

detect respective communication connections with the fluid end controller and the power end controller; and transmit requests for identifying information to the fluid end controller and the power end controller responsive to detecting the respective communication connections.

13. The hydraulic fracturing pump system of claim 8, wherein the primary controller is further configured to:

store the report and a different report relating to at least one of a different fluid end or a different power end that is a replacement for at least one of the fluid end or the power end.

14. The hydraulic fracturing pump system of claim 8, wherein the plurality of sensors include at least one of a speed sensor, a vibration sensor, a pressure sensor, or a temperature sensor.

15. The hydraulic fracturing pump system of claim 8, wherein the primary controller is further configured to:

detect a new communication connection to a different controller mounted to a different fluid end or a different power end that is a replacement for the fluid end or the power end in the hydraulic fracturing pump system;

transmit, based on detecting the new communication connection, a new request for identifying information to the different controller; and receive, in response to the new request, a different identifier from the different controller, wherein the different identifier uniquely identifies the different fluid end or the different power end.

16. A method, comprising:

detecting, by a primary controller of a hydraulic fracturing pump system, communication connections to a fluid end controller mounted to a fluid end and a power end controller mounted to a power end of a hydraulic fracturing pump of the hydraulic fracturing pump system;

transmitting, by the primary controller and based on detecting the communication connections, requests for identifying information to the fluid end controller and the power end controller;

receiving, by the primary controller in response to the requests, a fluid end identifier from the fluid end controller and a power end identifier from the power end controller;

obtaining, by the primary controller, measurements from a plurality of sensors connected to the hydraulic fracturing pump and associate fluid end measurements of the measurements with the fluid end identifier and power end measurements of the measurements with the power end identifier;

generating, by the primary controller, a report that indicates the fluid end identifier in relation to first data based on the fluid end measurements, and the power end identifier in relation to second data based on the power end measurements; and transmitting, by the primary controller, the report to the fluid end controller and to the power end controller.

17. The method of claim 16, further comprising:

detecting, by the primary controller, a new communication connection to a different controller mounted to a different fluid end or a different power end that is a replacement for the fluid end or the power end in the hydraulic fracturing pump system;

transmitting, by the primary controller and based on detecting the new communication connection, a new request for identifying information to the different controller; and receiving, by the primary controller in response to the new request, a different identifier from the different controller, wherein the different identifier uniquely identifies the different fluid end or the different power end.

18. The method of claim 17, further comprising:

storing the report and a different report relating to the different fluid end or the different power end.

19. The method of claim 16, wherein generating the report comprises generating an electronic file that contains the report in an image format, and wherein transmitting the report to the fluid end controller and to the power end controller comprises transmitting the electronic file to the fluid end controller and to the power end controller.

20. The method of claim 16, wherein the primary controller is remotely located from the hydraulic fracturing pump.

* * * * *